US005130077A

United States Patent [19]

Bernardet et al.

[11] Patent Number: 5,130,077

[45] Date of Patent: Jul. 14, 1992

[54] DEVICE FOR EXTRACTION AND ACCELERATION OF IONS IN A HIGH-FLUX NEUTRON TUBE WITH AN ADDITIONAL AUXILIARY PRE-ACCELERATION ELECTRODE

[75] Inventors: Henri Bernardet, Saint-Michel Sur Orge; Xavier L. M. Godechot, Yerres; Claude A. Lejeune, Gif/Yvette, all of France

[73] Assignee: U.S. Philips Corporation, New York, N.Y.

[21] Appl. No.: 416,892

[22] Filed: Oct. 4, 1989

[30] Foreign Application Priority Data

Oct. 7, 1988 [FR] France ..... 88 13184

[51] Int. Cl.[5] ..... H01J 33/00

[52] U.S. Cl. ..... 376/116

[58] Field of Search ..... 376/114, 115, 116, 117, 376/127, 129, 130

[56] References Cited

U.S. PATENT DOCUMENTS 3,015,032 12/1961 Hoyer ..... 376/117

3,344,299 9/1967 Bounden ..... 376/114

3,448,314 6/1969 Bounden et al. ..... 376/116

3,664,960 5/1972 Wood ..... 376/116

4,641,031 2/1987 Ito et al. ..... 250/423

*Primary Examiner*—Brooks H. Hunt

*Assistant Examiner*—Frederick H. Voss

*Attorney, Agent, or Firm*—Paul R. Miller

[57] ABSTRACT

A device is set forth for the extraction and acceleration of ions in a sealed high-flux neutron tube in which an ion beam (3) is extracted from an ion source (1), after which it is accelerated by means of an acceleration electrode (2) so as to be projected onto a target electrode (4) and produce therein a fusion reaction which causes an emission of neutrons. In accordance with the invention, the device also comprises an extraction-pre-acceleration electrode (13) which is arranged between the ion source and the acceleration electrode and which carries a potential such that the beam extracted from the ion source is initially rendered parallel or slightly diverging in order to obtain a laminated ion beam throughout the zone between the ion source and the target electrode.

5 Claims, 4 Drawing Sheets

DEVICE FOR EXTRACTION AND ACCELERATION OF IONS IN A HIGH-FLUX NEUTRON TUBE WITH AN ADDITIONAL AUXILIARY PRE-ACCELERATION ELECTRODE

The invention relates to a device for extraction and acceleration of ions in a sealed high-flux neutron tube comprising an ion source to supply, from an ionised gas, an ion beam to be extracted and accelerated with a high energy by means of an acceleration electrode and which is projected onto a target electrode in order to produce therein a fusion reaction which causes an emission of neutrons as a function of the large potential difference existing between the source and the target electrode.

BACKGROUND OF THE INVENTION

Neutron tubes of this kind are used in techniques for examination of substances by fast, thermal, epithermal or cold neutrons: neutronography, analysis by activation, analysis by spectrometry of inelastic diffusions or radiative captures, diffusion of neutrons, etc.

In order to make these nuclear techniques as effective as possible, longer tube service lives are required for the corresponding emission levels.

The fusion reaction $d(3_H, 4_{He})n$ which supplies 14 MeV neutrons is most commonly used because of its large effective cross-section for comparatively low ion energies. However, regardless of the reaction used, the number of neutrons obtained per unit of charge in the beam always increases in proportion to the increase of the energy of the ions directed toward a thick target, that is to say mainly beyond ion energies obtained in the sealed tubes which are available at present and which are powered by a high voltage which does not exceed 250 kV.

Erosion of the target by ion bombardment is one of the principal factors restricting the service life of a neutron tube.

The erosion is a function of the chemical nature and the structure of the target, on the one hand, and of the energy of the incident ions and their density distribution profile on the surface of impact, on the other hand.

In most cases the target is formed by a hydride (titanium, scandium, zirconium, erbium, etc.) which is capable of binding and releasing large quantities of hydrogen without substantially affecting its mechanical strength. The total quantity bound is a function of the temperature of the target and of the hydrogen pressure in the tube. The target materials used are deposited in form of thin layers whose thickness is limited by the problems imposed by the adherence of the layer to its substrate. One way of retarding the erosion of the target, for example, is to construct the absorbing active layer as a stack of identical layers which are isolated from one another by a diffusion barrier. The thickness of each of the active layers is in the order of magnitude of the penetration depth of deuterium ions striking the target.

Another method of protecting the target, thus increasing the service life of the tube, consists in influencing the ion beam so as to improve its density distribution profile on the surface of impact. For a constant total ion current on the target, leading to a constant neutron emission, this improvement with result from an as uniform as possible distribution of the current density across the entire target surface exposed to the ion bombardment.

One of the main causes of the inhomogeneity of the ion bombardment density profile is due to the range of high voltages (between 100 and 400 kV) to be applied between the electrodes of the tube in order to obtain a high neutron production yield of 14 MeV. The application of these high voltages during the extraction of ions and their subsequent acceleration by means of ion optical systems according to the present state of the art necessitates the addition, at the area of the emission zone of the tube, of either a grid or a deep channel which limits the penetration of the electrical field into the ion source.

A grid of conventional design may not be used because of thermal limitations, and the pattern of equipotential lines penetrating a deep emission channel causes substantial inhomogeneity of the beam. Because of the resultant aberrations, the interface zone between the ionised gas and the ion beam extracted therefrom has a concave surface of variable radius of curvature so that the beam emerging form the source is a converging but non-laminated type with a core plus a halo. This results in excess density at the impact of the axis of the beam on the target.

SUMMARY OF THE INVENTION

It is an object of the invention to provide a means of modifying the shape of the equipotential lines inside the channel so as to mitigate the inhomogeneity.

To this end, in accordance with the invention the device also comprises an extraction/pre-acceleration electrode which is arranged between the ion source and the acceleration electrode for carrying a potential valued between that of the ion source and that of the acceleration electrode in order to uncouple the ion extraction function, thus ensuring that the interface between the ionised gas and the ion beam has a controlled shape which varies from an ideal plane shape to a slight curvature of substantially constant radius so that the spherical aberrations are minimised and the beam becomes substantially laminated.

In practice the emission channels must be sufficiently open in order to obtain sufficiently large extracted currents. The extraction-pre-acceleration electrode, therefore, should comprise orifices which are at least equivalent. In order to preserve its shielding effectiveness as well as fixation of the equipotential lines in the extraction and acceleration spaces, various embodiments are possible as described hereinafter by way of example.

The orifices of the extraction-pre-acceleration electrode are provided with highly transparent, thick grids. The orientation of the grid is chosen so that it extends parallel to the beam. The materials used are refractory, resistant to pulverisation under the influence of the ion bombardment, and have a high thermal conductivity (molybdenum, tungsten, pyrolytic carbon etc.).

The emission orifices of the ion source are provided in multiple form. The orifices of the extraction-pre-acceleration electrode are in the same order of magnitude so that a multi-beam assembly without interception of ions is obtained: the small dimension of the orifices of the extraction-pre-acceleration electrode enables shielding against the penetration of the potential like a grid.

BRIEF DESCRIPTION OF THE DRAWINGS

The invention will be described in detail hereinafter with reference to the accompanying drawings.

Identical elements in the FIGURES are denoted by corresponding reference numerals.

DESCRIPTION OF THE INVENTION

Figure 1:
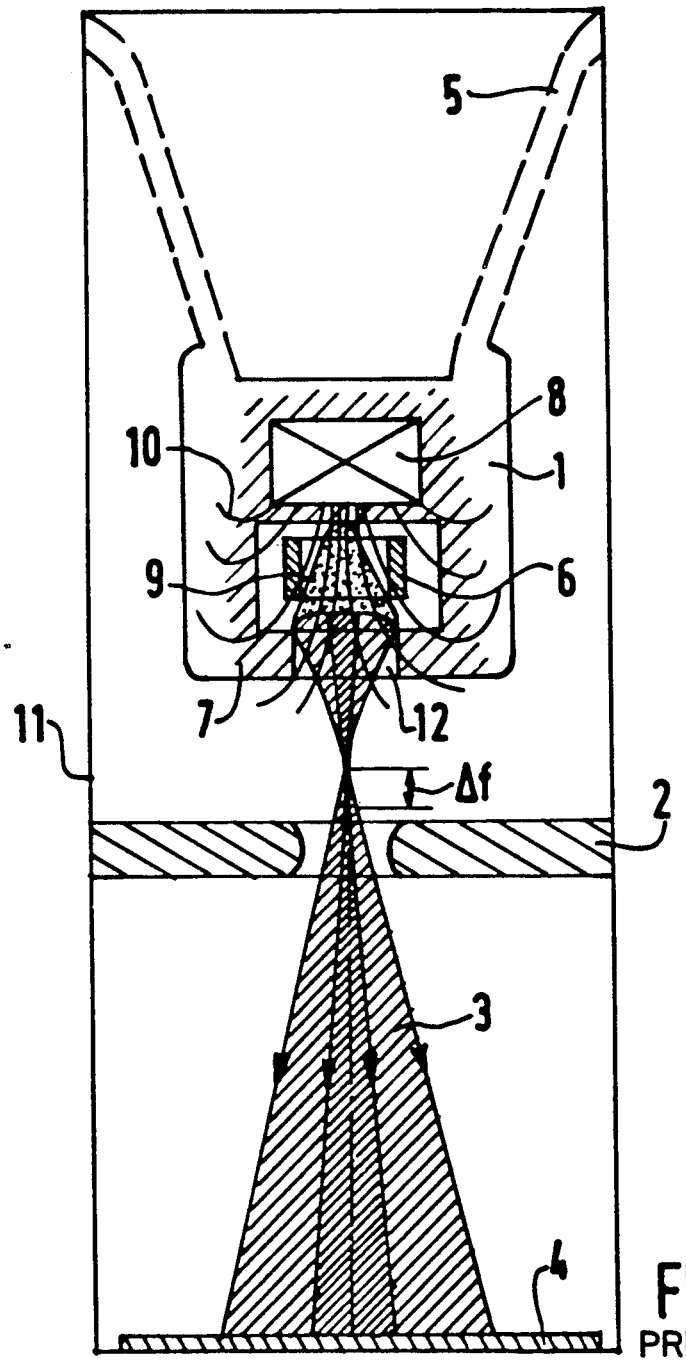
FIG.1 PRIOR ART
FIG. 1 shows the circuit diagram of a prior art sealed neutron tube.

The diagram of FIG. 1 shows the basic elements of a sealed neutron tube 11 which contains a low-pressure gaseous mixture to be ionised, for example deuterium-tritium, and which comprises an ion source 1 and an acceleration electrode 2 wherebetween a very high potential difference exists which enables extraction and acceleration of the ion beam 3 and its projection onto the target electrode 4 where a fusion reaction takes place which causes an emission of neutrons of, for example, 14 MeV.

The ion source 1 is integral with an insulator 5 for the passage of the high-voltage power supply connector (not shown) and is, for example a Penning-type source which is formed by a cylindrical anode 6, a cathode structure 7 which incorporates a magnet 8 with an axial magnetic field which confines the ionised gas 9 to the vicinity of the axis of the anode cylinder and whose lines of force 10 exhibit a given divergence. An ion emission channel 12 is formed in the cathode structure so as to face the anode.

The diagrams of FIG. 2 illustrate the target erosion effects.

Figures 2A, 2B, 2C, 2D:
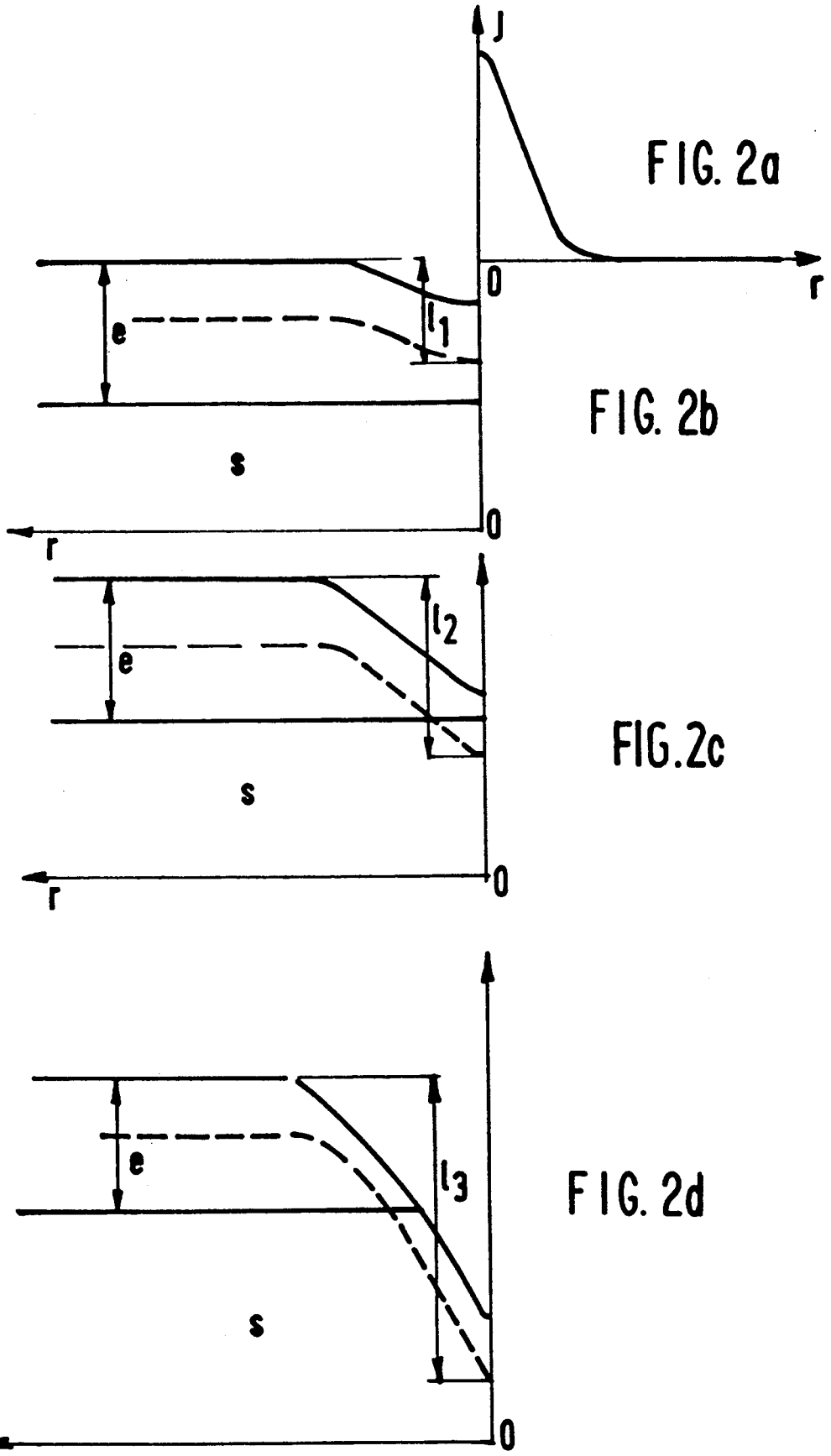
FIG. 2 shows the erosion effects in the depth of the target and the radial ion bombardment density profile.

FIG. 2*a* shows the density profile J of the ion bombardment in an arbitrary radial direction Or, starting from the point of impact O of the central axis of the beam on the surface of the target electrode for a standard ion optical system comprising a single electrode. The shape of this profile illustrates the inhomogeneous character of this beam where the very high density in the central part rapidly decreases towards the periphery.

FIG. 2*b* shows the erosion as a function of the bombardment density and the entire hydride layer having a thickness e and deposited on a substrate S is saturated with the deuterium-tritium mixture. The penetration depth of the energetic deuterium-tritium ions, denoted by a broken line, equals a depth $l_1$ as a function of this energy.

In FIG. 2*c* the erosion of the layer is such that the penetration depth $l_2$ is greater than the thickness e in the most heavily bombarded part. A part of the incident ions propagate in the substrate and the deuterium and tritium atoms are very quickly oversaturated.

In FIG. 2*d* the deuterium and tritium atoms collect and form bubbles which form craters upon bursting and which very quickly increase the erosion of the target at the depth $l_3$.

The latter process immediately precedes the end of the surface life of the tube, causing either a drastic increase of breakdowns (presence of microparticles resulting from the bursting of bubbles) or pollution of the target surface by the pulverised atoms which absorb the energy of incident ions.

In the Penning-type ion source 1 shown in FIG. 1 the cylindrical anode 6 connected to a potential which is approximately 4 kV higher than that carried by the cathode 7 which is connected to a very high voltage of, for example, positive 250 kV with respect to the envelope of the neutron tube 11.

The plasma ions are extracted from the source by the extraction-acceleration electrode 2 which is connected to ground potential O, via the emission channel 12 in the cathode which thus serves as the emission electrode. The ion beam 3 thus formed bombards the target 4 which is also connected to ground.

The large potential difference existing between the emission electrode and the extraction-acceleration electrode causes a deep penetration of the equipotential lines into the emission orifice 12. The mission meniscus at the interface between the ionised gas and the ion beam is thus shaped as a concave surface having a variable local radius of curvature. This causes aberrations at the level of the space where ions of the beam are extracted, so that not all ions are focused in the same point on the axis of the beam, but in a succession of points distributed over a given range $\Delta f$, thus causing inhomogeneity of bombardment of the target.

Figure 3:
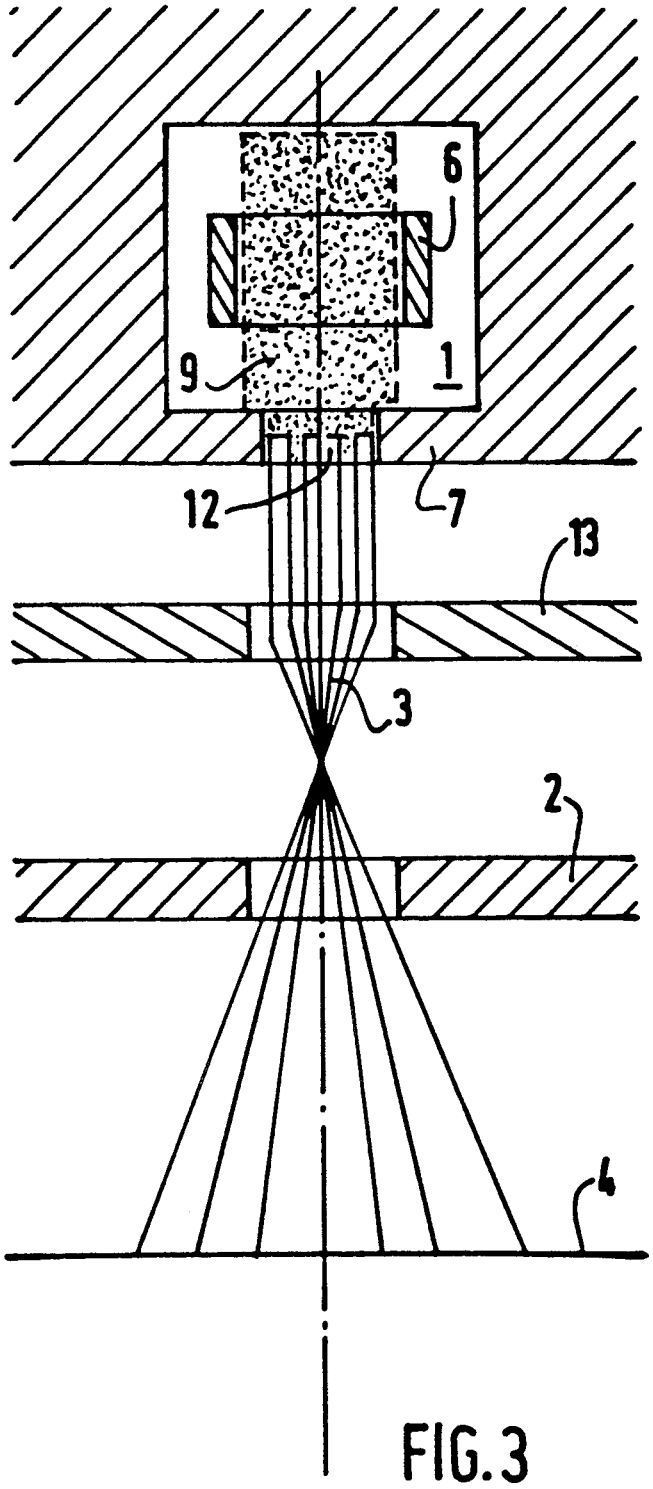
FIG. 3 shows the extraction and acceleration device in accordance with the invention.

In order to eliminate this cause of inhomogeneity of the ion beam, the idea of the invention which is shown in FIG. 3 consists in the insertion of an extraction-pre-acceleration electrode 13 between the ion source 1 and the acceleration electrode 2, which electrode 13 is connected to a potential which approximates that of the emission electrode, for example +235 kV. The small potential difference of 15 kV between the two electrodes thus tends to attenuate strongly and even eliminate the effect of the penetration of the equipotential lines into the emission orifices. The ions are thus extracted in a direction parallel to the axis of the beam, that is to say perpendicularly to the equipotential lines which theoretically form quasi-plane and parallel surfaces between the electrodes. This results in a plane or slightly spherical shape of the emission meniscus at the interface between the ionised gas and the ion beam. The beam emanating from this interface is laminated, i.e. in any point of its volume only a single path is transmitted. The laminated character is preserved when it is focused under the effect of the large potential gap existing between the extraction-pre-acceleration electrode 13 and the acceleration electrode. It still exists when the beam is incident on the target.

More generally speaking, the parallelism of the beam necessitates that the quantity of ions which can be delivered by the source is at least substantially equivalent to the quantity of ions which can in these conditions be extracted and accelerated by the ion optical system itself which is formed by the electrodes. The two ion optical source elements must be suitably adapted to one another in accordance with the wellknown laws of physics. For customary currents such an adaptation condition leads to a potential difference of some tens of kV between the extraction-pre-acceleration electrode 13 and the ion source 1 in the case of acceleration voltage in excess of 200 kV.

This ideal condition cannot be realised if the emission orifice is too large. This is an absolute necessity in neutron tubes in order to obtain sufficiently large currents. Actually for channel diameters of the order from about 1 to 2 cm. in the emission and extraction-pre-acceleration electrodes, the latter not longer acts as an effective shield with respect to the electric acceleration field in the vicinity of its open zone, so that its effect on the beam extracted from the source is seriously reduced. In order to mitigate this drawback, various solutions are feasible.

Figure 4:
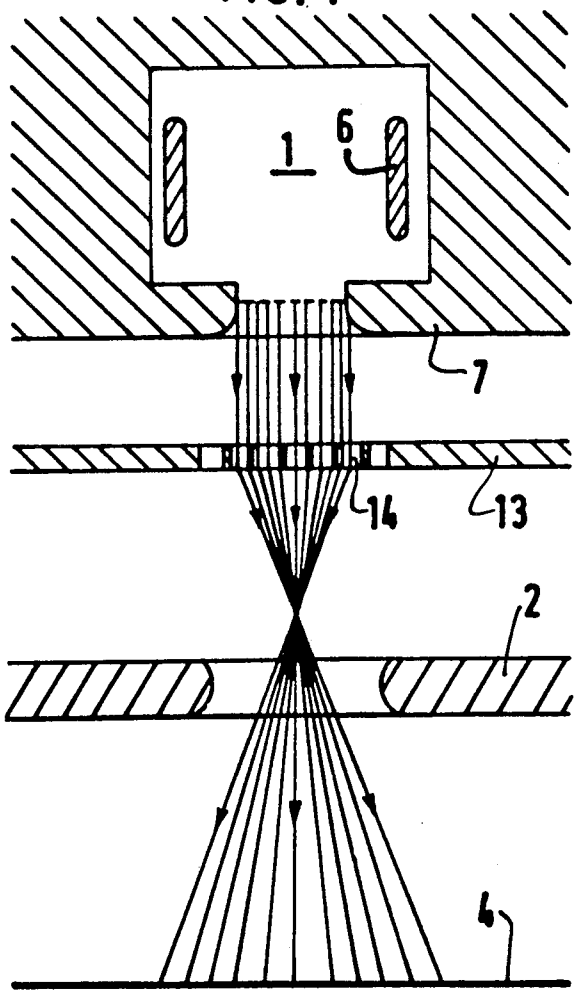
FIG. 4 diagrammatically shows an alternative version of the extraction system in accordance with the invention in which the extraction-pre-acceleration electrode comprises a grid.

For example, as indicated in FIG. 4 the extraction-pre-acceleration electrode 13 can be provided with a grid 14 in order to obtain an electrostatic shielding effect. However, under the influence of the ion bombardment which grid will be heated; this necessites the use of a thick grid in order to improve its thermal conductivity and the grid must also be made of a refractory material. This grid will be oriented so that the interception of ions is minimised, i.e. its openings will extend parallel to the beam.

Figure 5:
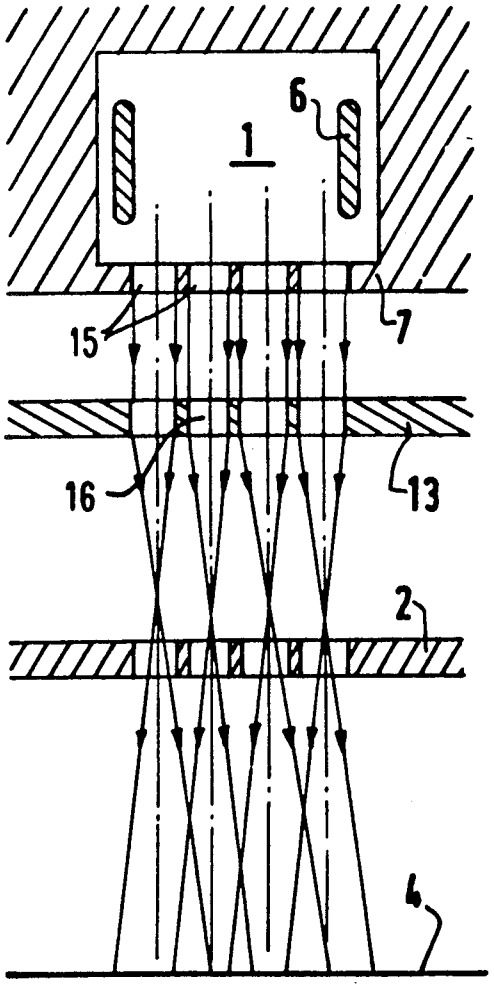
FIG. 5 diagrammatically shows a further version of the extraction and acceleration system in accordance with the invention, comprising several extraction orifices in alignment with the corresponding orifices in the extraction pre-acceleration electrode.

FIG. 5 diagrammatically shows another solution which involves the arrangement of multiple emission orifices 15 having a unity diameter of a few millimetres at the level of the ion source 1 and the alignment of these orifices with the corresponding orifices 16 in the extraction-pre-acceleration electrode 13. Thus, the interception of ions by this electrode and hence its heating are avoided, its shielding effect being preserved, however.

We claim:

1. An apparatus for extracting and accelerating ions in a high-flux neutron tube, said neutron tube including an ion source, electrode means including an acceleration electrode for forming a high energy ion beam from ionized gas, and target electrode means receiving said high energy ion beam for producing neutrons from a fusion reaction, said apparatus comprising pre-acceleration electrode means disposed between said ion source and said acceleration electrode for uncoupling ion extraction from ion acceleration, said pre-acceleration electrode means carrying a potential valued between an ion source potential and an acceleration electrode potential, wherein an interface between said ionized gas and said ion beam has a controlled shape, said controlled shape varying from an ideal plane shape to a slight curvature of substantially constant radius, thereby minimizing spherical aberrations and substantially laminating said ion beams, and wherein said pre-acceleration electrode means includes a highly transparent and thick grid, said grid having an orientation with openings parallel to said ion beam.

2. An apparatus according to claim 1, wherein said grid is resistant to ion bombardment and has a predetermined thermal conductivity.

3. An apparatus according to claim 2, wherein said grid is a refractory material of one of molybdenum, tungsten and pyrolytic carbon.

4. An apparatus according to claim 1, wherein said ion source has multiple orifices, said multiple orifices being aligned with said openings in said grid.

5. An apparatus for extracting and accelerating ions in a high-flux neutron tube, said neutron tube including an ion source, electrode means including an acceleration electrode for forming a high energy ion beam from ionized gas, and target electrode means receiving said high energy ion beam for producing neutrons from a fusion reaction, said apparatus comprising pre-acceleration electrode means disposed between said ion source and said acceleration electrode for uncoupling ion extraction from ion acceleration, said pre-acceleration electrode means carrying a potential valued between an ion source potential and an acceleration electrode potential, and said pre-acceleration electrode means having a plurality of openings, wherein an interface between said ionized gas and said ion beam has a controlled shape, said controlled shape varying from an ideal plane shape to a slight curvature of substantially constant radius, thereby minimizing spherical aberrations and substantially laminating said ion beams, and wherein said ion source has multiple emission orifices, said multiple emission orifices being separated from and aligned with said plurality of openings in said pre-acceleration electrode means.

* * * * *